United States Patent [19]

Denner et al.

[11] 4,407,064

[45] Oct. 4, 1983

[54] APPARATUS FOR PULLING TRANSVERSE FINS ONTO A PLURALITY OF PIPES

[75] Inventors: Peter Denner; Egon Ernst, both of Ratingen; Alfred Jockel, Essen, all of Fed. Rep. of Germany

[73] Assignee: Balcke-Dürr Aktiengesellschaft, Ratingen, Fed. Rep. of Germany

[21] Appl. No.: 148,311

[22] Filed: May 9, 1980

[30] Foreign Application Priority Data

May 26, 1979 [DE] Fed. Rep. of Germany ..... 2921415

[51] Int. Cl.[3] ..... B23P 15/26

[52] U.S. Cl. ..... 29/726

[58] Field of Search ..... 29/157.3 A, 157.3 B, 29/726, 793, 794, 795, 822, 823

[56] References Cited

U.S. PATENT DOCUMENTS

| | | | |
|---|---|---|---|
| 1,996,566 | 4/1935 | Boerger | 29/726 |
| 2,006,383 | 7/1935 | Boerger | 29/726 X |
| 2,133,932 | 10/1938 | Whistler et al. | 29/726 |
| 2,154,855 | 4/1939 | Lear | 29/726 |
| 2,247,730 | 7/1941 | O'Brien | 29/726 X |
| 3,095,638 | 7/1963 | Seien | 29/726 X |
| 3,095,639 | 7/1963 | Seien | 29/726 X |
| 3,798,732 | 3/1974 | Schulenberg et al. | 29/726 |
| 3,798,733 | 3/1974 | Schulenberg et al. | 29/726 |
| 3,802,048 | 4/1974 | Schulenberg | 29/726 |
| 3,815,203 | 6/1974 | Schulenberg et al. | 29/726 |

FOREIGN PATENT DOCUMENTS 1099976 2/1961 Fed. Rep. of Germany ... 29/157.3 A

*Primary Examiner*—Ervin M. Combs

*Attorney, Agent, or Firm*—Martin A. Farber

[57] ABSTRACT

An apparatus invention relates to an apparatus for pulling transverse fins onto a plurality of pipes which are arranged fixed in position alongside of each other by means of carriers the ends of which are operatively supported on respective endless carrier-conveyor chains between a working position engaging the fin plates and a disengagement position releasing the fin plates, the carrier being provided with at least one support foot which holds the carrier in the working position. The support foot is supported on support members of a control device which holds the carriers in the working position on the transport path until release of the transverse fins and releases them for swinging depending on the fin spacing and the transverse fins which have already been pulled-on, the point of release moving in a direction opposite the direction of movement of the carrier conveyor chains. In order to reduce the friction and increase the reliability of operation, the fin pull-on path is divided into a transport region and a control region. Furthermore the control device comprises a control side which is arranged at the end of the transport path and on which the carriers support themselves by at least one support foot.

13 Claims, 6 Drawing Figures

APPARATUS FOR PULLING TRANSVERSE FINS ONTO A PLURALITY OF PIPES

The present invention relates to an apparatus for pulling transverse fins onto a plurality of pipes which are arranged in fixed position alongside of each other by means of carriers the two ends of which are swingably supported on respective endless carrier conveyor chains between a working position engaging the fin plates and a disengagement position releasing the fin plates, the carriers being provided with at least one support foot which holds the carriers in the working position and is supported on support members of a control device which holds the carriers in the working position on the transport path until release of the transverse fins and releases them for swinging as a function of the spacing between the fins and the transverse fins which have already been pulled on, the point of release moving in a direction opposite to the direction of movement of the carrier conveyor chains.

One apparatus of the aforementioned type is known from West German Pat. No. 1 752 831. In this known embodiment, the support members of the control device are developed as support jaws which are arranged on a chain. The last support jaw at the same time controls the release of the carriers for swinging out of the working position into the release position as soon as the respective support foot has left the rear edge of the support jaw.

This known apparatus not only has the disadvantage that the sliding movement of the support feet on the support jaws has a considerable amount of friction inherent in it which, due to the moments of rotation which occur in, and the relatively short lever arms, also leads to a large amount of wear, but that, in addition, the precision of the spacing of the fins is insufficient.

The object of the present invention is to avoid the above-described disadvantages and to create an apparatus for the pulling of transverse fins onto a plurality of pipes arranged fixed in position alongside of each other which, with less consumption of energy and substantially reduced wear provides a higher precision of the spacing of the fins.

The attainment of this objective by the invention is characterized in the manner that the fin pull-on path is subdivided into a transport region and a control region and the control device comprises a control slide which is arranged at the end of the transport path and against which the carriers rest by means of at least one support foot.

By the subdivision of the entire fin pull-on path into a purely transport region and a control region the possibility is obtained, in order to reduce the friction and facilitate the transport of the transverse fins in the transport region, of increasing the tolerances for the supporting of the support feet on the support members and nevertheless of obtaining within the control region exact retention of the predetermined point for the swinging-over of the carriers and thus release of the transverse fins on the pipes since for this there is used the control slide of the invention which not only itself has a more precise guidance but, due to its short length, can be developed with higher precision with respect to the support and guidance of the carrier support feet. By the development in accordance with the invention there is thus obtained a reduction in the frictional forces for the pulling-on of the transverse fins and nevertheless a considerably increased accuracy for the guidance and the release point in the control region, which is controlling for the precision of the spacing of the fins.

In accordance with another feature of the invention, the control slide is guided on fixed guide bars parallel to the upper course of the carrier conveyor chains and is displaceable by at least one control chain which, including the control slide, is of endless construction. By this further development of the invention there is obtained, on the one hand, a good guidance of the control slide and, on the other hand, a structurally simple solution for the movement of the control slide, which movement must be adapted to the movement of the carrier conveyor chains.

Each carrier of the apparatus of the invention is provided with preferably three adjacent support feet, the two outer support feet being supported on the control slide exclusively at the end of the transport path while the central support foot rests on the control chain exclusively in the transport region prior to reaching the control slide. The tolerances between the lateral support feet and the control slide are in this connection less in accordance with the invention than the tolerance between the central support foot and the control chain so that with this development of the apparatus in accordance with the invention low frictional forces in the transport region and high precision in the control region are obtained.

In a further development of the invention, the control chain is developed as a three-strand chain, the outer strands of which are supported on stationary support rails and the central strand of which is provided as a direct support for the central support foot of the carriers solely in the transport region. This development of the control chain not only results in a structurally particularly simple development for the support of the central support foot in the transport region but avoids any interference with the swinging motion of the carriers after their release by the control slide. If the control chain is furthermore developed as a three-strand roller chain with rollers which can rotate freely independently of each other, there is then obtained a quasi-rolling friction between the central support foot of the carriers and the control chain, which results in only slight frictional losses and in scarcely any wear.

Each support foot is connected, in accordance with the invention, via a lever arm with the flight, the lever arm extending on the rear side of the carrier approximately perpendicular to the carrying or driving surface of the carrier. In this way there is obtained a large lever arm so that the supporting of the carriers both on the control chain and on the control slide results in only a slight load acting on these parts.

In a preferred embodiment of the invention the carriers are supported for free rotation on a shaft which extends between and passing through the carrier conveyor chains and carriers on each side, outside of the carrier conveyor chains, a travel roller which rolls on a stationary travel rail. This development is particularly simple and reliable in operation.

In order to obtain a dependable support of the control chain, the rollers of the outer strands of the control chain roll on the arms of a support rail of U-shaped cross section which is arranged, fixed in position, in the center between the travel rails and the guide bars over the entire length below the upper course of the control chain. The guide bars for the control slide are of circular cross section in order to obtain not only a reliable guidance but also a guidance which is simple to manufacture.

Finally, it is proposed by the invention to provide the control slide at its control edge with a cut-out for the central support feet so that the control slide does not interfere with the carriers as they swing from the working position into the disengagement position.

One illustrative embodiment of the apparatus of the invention is shown in the drawing, in which.

Figure 1:
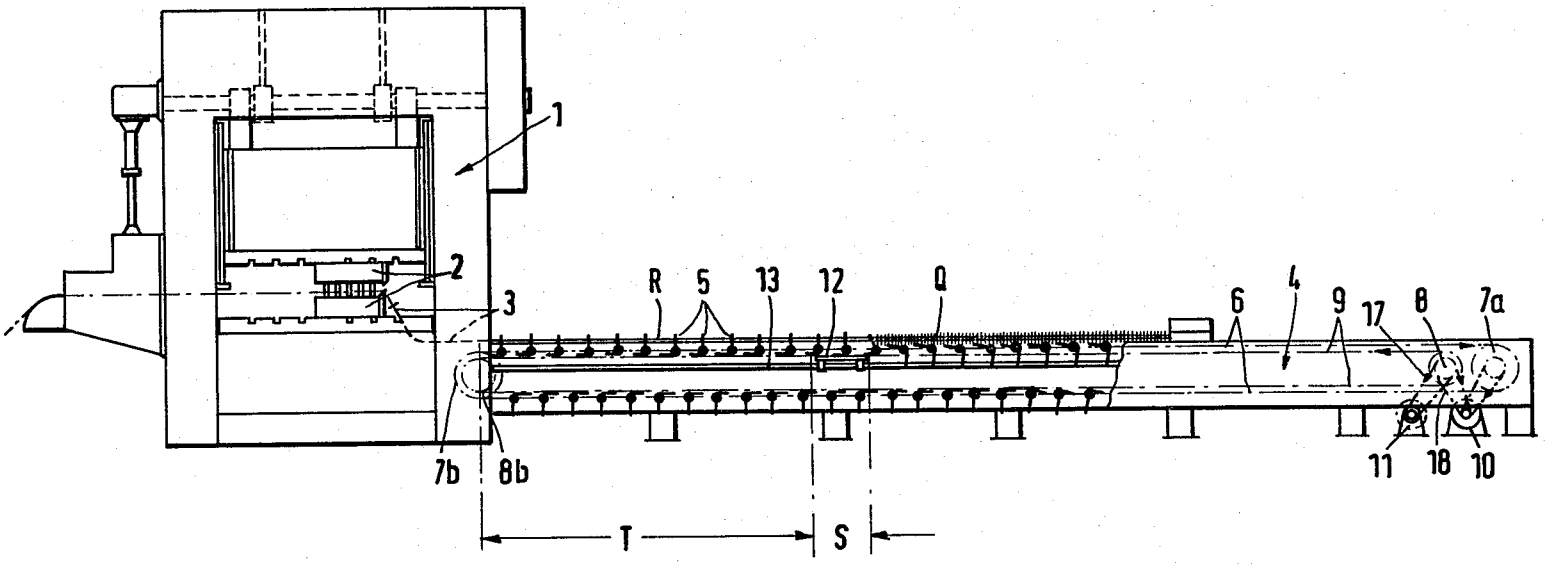
FIG. 1 is a diagrammatic side view of the entire apparatus.

The apparatus which is shown diagrammatically in side view in FIG. 1 operates together with a punch 1 which is developed, for instance, as an eccentric press and delivers transverse fin plates Q which are pulled onto a plurality of pipes R which are arranged fixed in position alongside of each other. In the embodiment shown in the drawing, there are six such pipes which are simultaneously equipped by the pull-on delivery operation with the transverse fin plates Q.

The transverse fin plates Q produced by the punch 1, for instance from strip material, by means of punch tools 2 are fed by means of a guide 3 to a pull bench 4 which adjoins the punch 1 and has carriers 5 which pull the transverse fin plates Q onto the pipes R with a predetermined distance between the fins. The carriers 5 are arranged on carrier conveyor chains 6 which conduct the transverse fin plates Q, each of which covers all six pipes R, from the punch 1 up to the predetermined place on the pipes R. For this purpose, the carrier conveyor chains 6 are endless and are guided on sprocket wheels 7*a* and 7*b*.

The pull-on path for the transverse fin plates Q, i.e. the distance from the punch 1 to the from time to time respective position on the pipes R is divided into a transport region T and a control region S. Both in the transport region T and in the control region S the transverse fin plates Q are pushed by the carriers 5 on the pipes R, the transverse fin plates Q being held with their surfaces at all times at a right angle to the longitudinal direction of the pipes R. For this purpose the carriers 5 are located in both regions in a so-called working position. The difference between the two regions is that in the transport region T the carriers 5 are supported as free as possible of friction and their support requires a certain play between the structural parts while in the control region S an exact guidance of the carriers 5 is necessary in order to assure the required precision of the spacing of the fins, i.e. the distance apart of the fins on the pipes R. As soon as each transverse fin plate Q has reached its predetermined position on the pipes R, the carrier 5 is released so that it can swing out of its working position in which it engages the transverse fin plates Q, into a disengagement position in which it releases the transverse fin plates.

The supporting of the carriers 5 in the transport region T is effected by a control chain 9 which is guided over sprocket wheels 8*a* and 8*b*, which control chain 9, in the same way as the carrier chains 6, is driven by a drive motor 10 via a feed gear 11 and a feed drive 17 as a function of the speed of the carrier conveyor chains 6 but in the opposite direction of motion. After the termination of the entire pulling-on operation, the control slide 12 is returned via the recovery drive 18 to its initial position.

In the control region S the support of the carriers 5 is effected by a control slide 12 which is displaceably guided on stationary guide rods 13 and is moved by the control chain 9 which for this purpose engages the front and rear ends of the control slide 12 and, together with the latter, is of endless construction. The further details of this construction can be noted from FIGS. 2 to 6.

Figure 3:
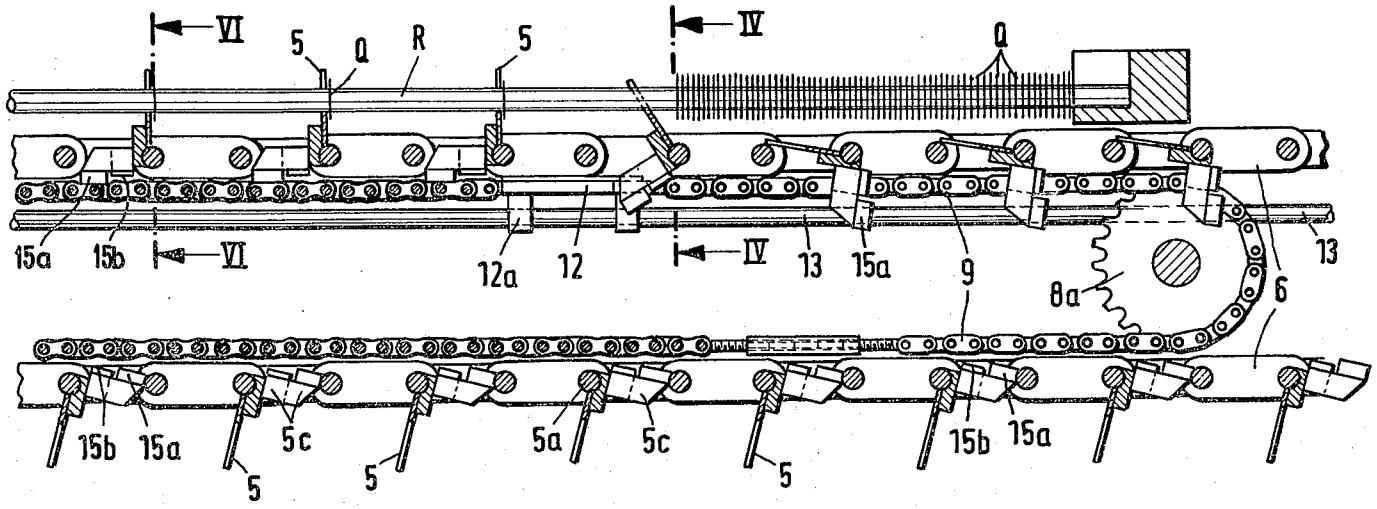
FIG. 3 is a longitudinal section along the section line III—III of FIG. 2.
Figure 2:
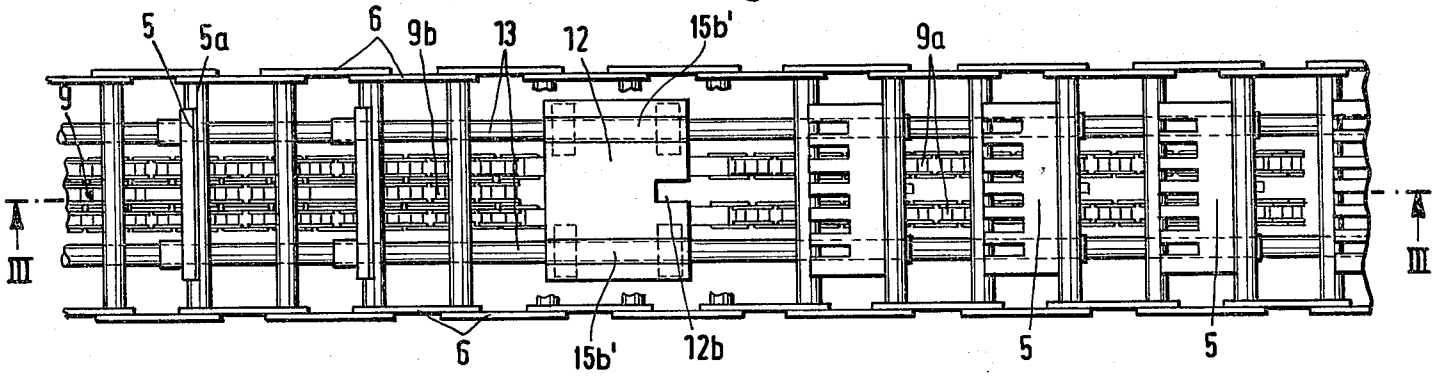
FIG. 2 is a top view of a part of the apparatus, shown on a larger scale.
Figure 4:
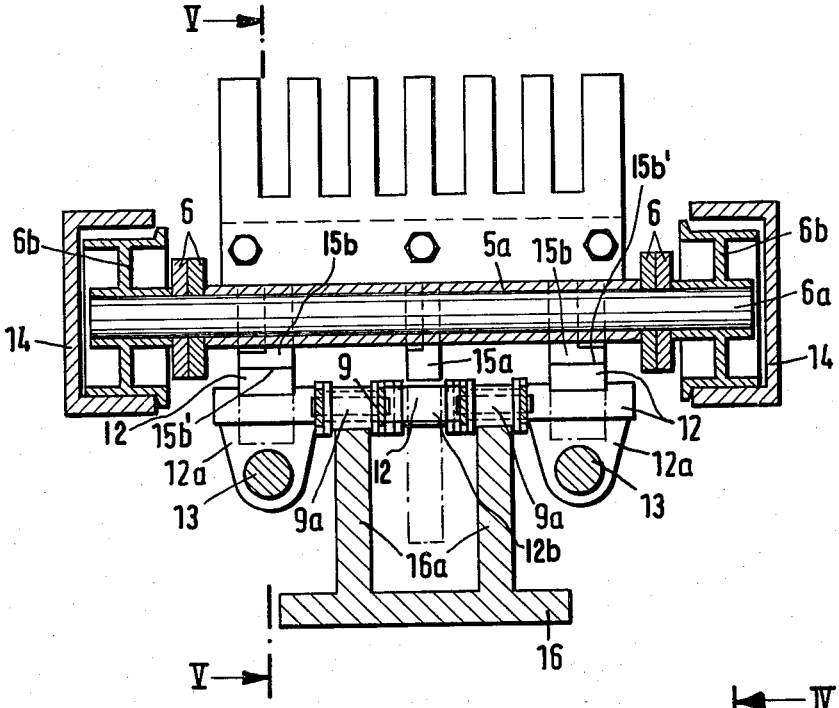
FIG. 4 is a cross section through the apparatus along the section line IV—IV of FIG. 3, shown on a larger scale.

As shown in particular in FIG. 4, the carrier conveyor chains 6 are developed as sprocket chains which are connected with each other by a shaft 6*a*. This shaft 6*a* extends on both sides beyond the flight conveyor chains 6 and carries on each of its ends a travel roller 6*b*, these rollers being supported on fixed travel rails 14. These travel rails 14 as well as the travel rollers 6*b* have been omitted from FIGS. 2 and 3 for the sake of clarity of the figures.

Figure 6:
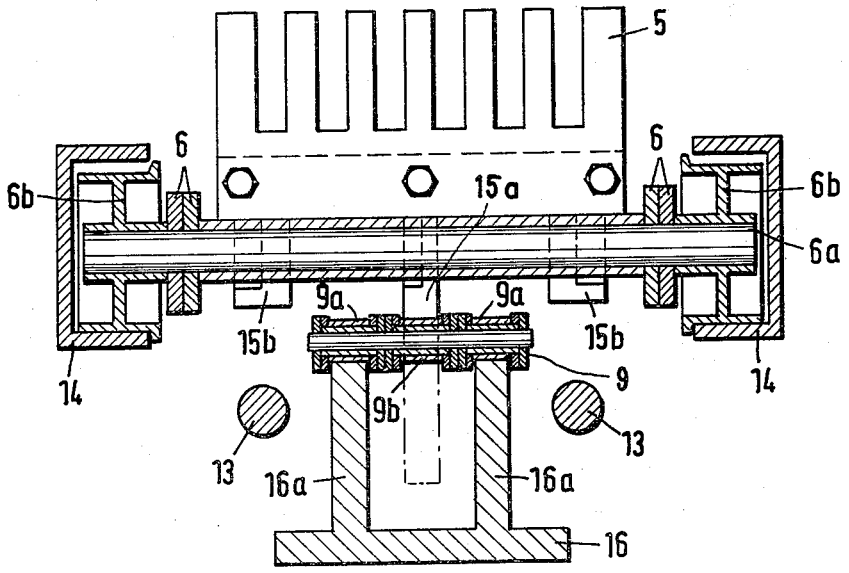
FIG. 6 is another cross section, shown on a larger scale, along the section line VI—VI of FIG. 3.

Each carrier 5, whose comb-like development can be noted from FIGS. 4 and 6, is mounted, freely turnable by means of a sleeve 5*a*, on the shaft 6*a*. On its rear it has a mounting part 5*b* which is connected with the sleeve 5*a*. On this mounting part 5*b* there are arranged, for each carrier 5, three lever arms 5*c* each of which carries a support foot 15*a* or 15*b* respectively.

Of these three support feet 15*a*, 15*b* the central support foot 15*a* is located in the longitudinal center of the carrier 5. In the transport region T it is supported on the control chain 9, which for this purpose is constructed as a three-strand chain, namely as a roller chain with three rows of rollers turnable independently of each other. While the two outer strands 9*a* of the control chain 9 are endless, the central strand 9*b* extends merely within the transport region T. The central support feet 15*a* of the carriers 15 are thus held in working position exclusively in the transport region T by the central strand 9*b* of the control chain 9 while the absence of the central chain 9*b* adjoining the control region S permits a swinging of the carriers 5 out of the working position into the disengagement position, as shown in FIGS. 1 and 3. In order to assure a good support of the central support feet 15*a* which roll on the rollers of the central strand 9*b*, the two outer strands 9*a* of the control chain 9 are supported, over the entire length of the pull-on bench 4, on the arms 16*a* of a support rail 16 of U-shaped cross section which is arranged fixed in position and can be noted from FIGS. 4 and 6.

Figure 5:
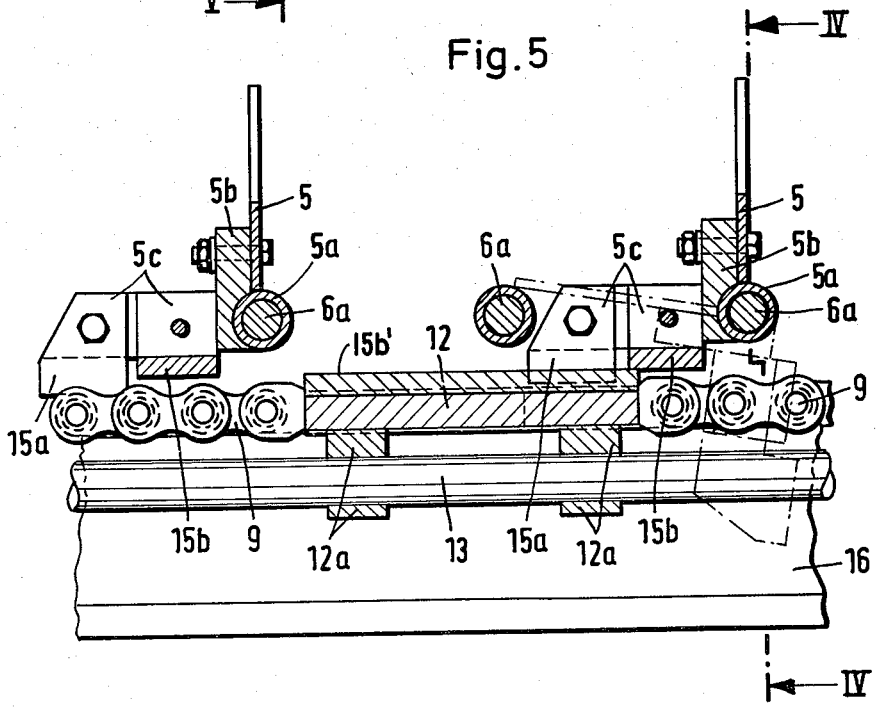
FIG. 5 is a longitudinal section along the section line V—V of FIG. 4.

The two outer support feet 15*b* of each carrier 15 are arranged laterally outside of the control chain 9, as shown in FIGS. 4 to 6. These outer support feet 15*b* are used solely in the control region S when they are supported on the control slide 12. This support which is developed with greater precision than the support of the central support foot 15*a* on the control chain 9 is shown in FIGS. 4 and 6. These figures also show that the control slide 12 is guided precisely by guide flanges 12*a* on the guide bars 13 which are of circular cross section. In order not to interfere with the swinging movement of the carriers 5, the control slide 12 is provided at its control edge with a cutout 12*b* for the central support feet 15*a* to pass therethrough during release and swinging of the carriers about the shafts 6a (see FIG. 2).

The transverse fin plates Q delivered by the punch 1 pass via the guides 3 to the pull-on bench 4, where they are each grasped by a carrier 5. These carriers 5 which are arranged between the carrier conveyor chains 6 are moved by the rotation of the carrier conveyor chains 6 from the punch 1 in the direction towards the part of the pipes R which have already been provided with fins. In the transport region T, they are held by means of their central support foot 15a respectively in the working position in engagement with the transverse rib plates Q, this central support foot 15a being supported on the central strand 9b of the control chain 9. In this connection the support foot 15a rolls over the freely rotating rollers of the central strand 9b.

As soon as the carrier 5 transporting the transverse fin plate Q in question reaches the control slide 12, the outer support feet 15b now hold the carrier 5 in the working task carrier position. They are supported for this purpose on slide tracks 15b' formed for this on the control slide 12 tracks formed. In this connection the central support foot 15a terminates its support function by not contacting the control slide 12. As soon as the outer support feet 15b reach the rear edge of the control slide 12, the carrier 5 is released for swinging in a direction opposite to its direction of transport. It swings away towards the rear so that the transverse fin plate Q remains in the position now reached on the pipes R. Since the central strand 9b of the control chain 9 is absent behind the control slide 12 and this control slide 12 is furthermore provided with a cutout 12b, the free swingability of the carrier 5 is not interfered with after its release. It moves in its disengaged position to the end of the upper course of the conveyor chain and then along the lower course back to the punch 1 where the operation described above is repeated for each carrier 5.

Since the point of release of the carriers 5 shifts in the direction towards the punch 1 as the accommodation of the fins on the pipes R proceeds, the slide 12 is displaced opposite to the direction of motion of the carrier chains 6 by means of the control chain 9. This displacement takes place synchronously as a function of the speed of the carrier chains 6, but in the opposite direction. The transport region T thus becomes smaller and smaller as the finning operation proceeds, while the control region S remains the same size at all times. As soon as the pipes R have been fully equipped with fins, they are taken off from above from the pull-on bench 4 and replaced by new pipes R which in their turn are provided with transverse fins Q in the manner described above. By means of the recovery drive 18 shown in FIG. 1, the control chain 9 is first of all moved back with the control slide 12 into the starting position.

We claim:

1. An apparatus for pulling transverse fin plates onto a plurality of pipes which are arranged fixed in position alongside of each other by carriers which are operatively swingably supported at two ends thereof to respective endless carrier conveyor chains between a working position engaging the fin plates and a release position which releases the fin plates, the carriers being provided with at least one support foot which holds the carriers in the working position, the at least one support foot being supported on support members of a control device which holds the carriers in the working position along a transport path where the fin plates are pulled on the pipes until the release of the transverse fin plates, and the control device releases the carriers for swinging at a point of release as a function of the spacing between the fin plates and the thickness of the transverse fin plates and which have already been pulled on the pipes, the point of release moving opposite to the direction of motion of the carrier conveyor chains, the improvement wherein the transport path is subdivided into a transport region and a control region, respectively, by different respective support formations on said support members, said different respective support formations constitute support means for the holding of the carriers in the working position via the at least one support foot in the transport region and in the control region, respectively, the control device includes a first of the support members comprising a control slide with one of said different respective support formations defining said control region and disposed exclusively at an end of the transport path, and a plurality of second of the support members disposed in said transport region, said first and second support members include said different respective support formations, the at least one support foot includes at least one support foot means for supporting said carriers, respectively, via said one of said different respective support formations on said control slide, the latter constituting means for precisely releasing said at least one support foot means and said carriers, respectively, and other of said different respective support formations of said second support members comprise said support means for providing a different support of said at least one support foot means with more play and less friction per unit path than that of said one of said different respective support formations of said control slide.

2. The apparatus according to claim 1, further comprising stationary guide bars being mounted parallel to an upper course of the carrier conveyor chains, said control slide being displaceably guidably mounted on said stationary guide bars, the control device includes a control chain means for displacing said control slide on said stationary guide bars opposite to the direction of motion of the carrier conveyor chains said control chain means includes said second support members, and said control chain means including said control slide is endless.

3. The apparatus according to claim 1, wherein said support means formation of said first support member is different from said support means formation of said second support members.

4. The apparatus according to claim 1, further comprising stationary travel rails mounted such that said carrier conveyor chains are therebetween, a plurality of shafts extend between and pass through said carrier conveyor chains, travel rollers are mounted on said shafts, said travel rollers roll on said stationary travel rails, and said carriers are mounted for free rotation on said shafts, respectively.

5. The apparatus according to claim 2, wherein said guide bars have circular cross-sections, respectively.

6. An apparatus for pulling transverse fin plates onto a plurality of pipes which are arranged fixed in position alongside of each other by carriers which are operatively swingably supported at two ends thereof to respective endless carrier conveyor chains between a working position engaging the fin plates and a release position which releases the fin plates, the carriers being provided with at least one support foot which holds the carriers in the working position, the at least one support foot being supported on support members of a control device which holds the carriers in the working position along a transport path where the fin plates are pulled on the pipes until the release of the transverse fin plates, and the control device releases the carriers for swinging at a point of release as a function of the spacing between the fin plates and the thickness of the transverse fin plates and which have already been pulled on the pipes, the point of release moving opposite to the direction of motion of the carrier conveyor chains, the improvement wherein the transport path is subdivided into a transport region and a control region, the control device includes a control slide disposed at an end of the transport path, the at least one support foot includes at least one support foot means for supporting said carriers, respectively, on said control slide, stationary guide bars are mounted parallel to an upper course of the carrier conveyor chains, said control slide is displaceably guidably mounted on said stationary guide bars, the control device includes a control chain means for displacing said control slide on said stationary guide bars, said control chain means including said control slide is endless, said at least one support foot comprises three support feet arranged alongside of each other, and said three support feet constitute two outer support feet which constitute said supporting means and are supported on said control slide exclusively in said control region, and a central support foot which is supported on said control chain means exclusively in the transport region before reaching said control slide.

7. The apparatus according to claim 6, wherein play between said outer support feet and said control slide supporting said outer support feet in said control region is less than play between said central support foot and said control chain means supporting said central support foot in said transport region.

8. The apparatus according to claim 6, further comprising stationary support rails, and said control chain means constitutes a three-strand chain having outer strands supported on said stationary support rails, respectively, and a central strand constituting means for directly supporting said central support foot means of the carriers, respectively, exclusively in the transport region.

9. The apparatus according to claim 8, wherein said control chain means constitutes a three-strand roller chain having a plurality of rollers which are freely rotatable independently of each other.

10. The apparatus according to claim 6, further comprising one lever arm means for connecting each said support foot with the carrier, respectively.

11. The apparatus according to claim 10, wherein each said carrier has a fin plate carrier surface, and each said lever arm means extends on a rear of said carrier approximately at right angles to said fin plate carrier surface.

12. The apparatus according to claim 6, wherein said control slide is formed on a control edge with a cutout means for the central support foot of the carriers, respectively, to pass therethrough during the release of the carriers.

13. An apparatus for pulling transverse fin plates onto a plurality of pipes which are arranged fixed in position alongside of each other by carriers which are operatively swingably supported at two ends thereof to respective endless carrier conveyor chains between a working position engaging the fin plates and a release position which releases the fin plates, the carriers being provided with at least one support foot which holds the carriers in the working position, the at least one support foot being supported on support members of a control device which holds the carriers in the working position along a transport path where the fin plates are pulled on the pipes until the release of the transverse fin plates, and the control device releases the carriers for swinging at a point of release as a function of the spacing between the fin plates and the thickness of the transverse fin plates and which have already been pulled on the pipes, the point of release moving opposite to the direction of motion of the carrier conveyor chains, the improvement wherein the transport path is subdivided into a transport region and a control region, the control device includes a control slide disposed at an end of the transport path, the at least one support foot includes at least one support foot means for supporting said carriers, respectively, on said control slide, stationary travel rails mounted such that said carrier conveyor chains are therebetween, a plurality of shafts extend between and pass through said carrier conveyor chains, travel rollers are mounted on said shafts, said travel rollers roll on said stationary travel rails, said carriers are mounted for free rotation on said shafts, respectively, stationary guide bars are mounted parallel to an upper course of the carrier conveyor chains, said control slide is displaceably guidably mounted on said stationary guide bars, the control device includes a control chain means for displacing said contrpl slide on said stationary guide bars, said control chain means including said control slide is endless, a support rail of U-shaped cross-section defining arms is arranged fixed in position centrally between said travel rails and said guide bars over the entire length of and below an upper course of the control chain means, said control chain means constitutes a multiple strand chain having outer strands and rollers mounted thereon, and said rollers on said outer strands of said control chain means roll on said arms of said support rail.

* * * * *